US005230926A

United States Patent [19]

Narang et al.

[11] Patent Number: 5,230,926

[45] Date of Patent: Jul. 27, 1993

[54] APPLICATION OF A FRONT FACE COATING TO INK JET PRINTHEADS OR PRINTHEAD DIES

[75] Inventors: Ram S. Narang, Fairport; Stephen F. Pond, Pittsford; Robert A. Harold, Sr., Rochester, all of N.Y.

[73] Assignee: Xerox Corporation, Stamford, Conn.

[21] Appl. No.: 874,863

[22] Filed: Apr. 28, 1992

[51] Int. Cl.[5] ..... B05D 1/28; B05C 1/00; B05C 13/00

[52] U.S. Cl. ..... 427/289; 427/428; 427/430.1; 118/59; 118/207; 118/244; 118/413; 118/503; 346/140 R; 346/1.1; 29/890.1

[58] Field of Search ..... 346/140 R, 1.1; 29/890.1, 423; 118/503, 207, 208, 212, 213, 244, 413, 59, 500; 427/289, 428, 430.1

[56] References Cited

U.S. PATENT DOCUMENTS

| | | | |
|---|---|---|---|
| 3,453,989 | 7/1969 | Bippus | 118/503 |
| 4,393,808 | 7/1983 | Braden | 118/503 |
| 4,733,447 | 3/1988 | Ageishi | 29/890.1 |
| 5,016,023 | 5/1991 | Chan et al. | 29/890.1 |
| 5,016,024 | 5/1991 | Lam et al. | 29/890.1 |
| 5,068,006 | 11/1991 | Fisher | 156/657 |

OTHER PUBLICATIONS

"Dual-Station Glassing Fixture", N. L. Robinson, IBM Technical Disclosure Bulletin vol. 19, No. 18, Jan. 1977, p. 2897.

*Primary Examiner*—W. Gary Jones
*Assistant Examiner*—Todd J. Burns
*Attorney, Agent, or Firm*—Oliff & Berridge

[57] ABSTRACT

A method and apparatus for applying a coating to a front face of an ink jet print head die or print head die comprise positioning a die in a cut out in a top surface of a block such that the die extends from the top surface of the block. An applicator such as a roller or flat blade is used to apply the coating to at least an upper surface of the die as the applicator rides along the upper surface of the die. When a roller is used as the applicator, the roller has a recess corresponding to the extension of the die from the top surface of the block. The roller recess contains a piece of elastomeric material which extends to an outer portion of the roller adjacent to said roller recess. The method and apparatus facilitate transfer of a thin, uniform film of coating to an ink jet printer print head die or a completed ink jet printer print head.

17 Claims, 1 Drawing Sheet

APPLICATION OF A FRONT FACE COATING TO INK JET PRINTHEADS OR PRINTHEAD DIES

CROSS-REFERENCE TO RELATED APPLICATION

This application is related to U.S. patent application Ser. No. 07/874,865, filed Apr. 28, 1992, now U.S. Pat. No. 5,218,381 entitled "Hydrophobic Coating for a Front Face of a Printhead in an Ink Jet Printer", the disclosure of which is incorporated by reference herein.

BACKGROUND OF THE INVENTION

1. Field of the Invention

The present invention relates to a method and apparatus for applying a front face coating to ink jet printheads or ink jet printhead dies and, more particularly, to a method and apparatus for applying a longlasting hydrophobic coating to the front face of ink jet printer printheads or dies.

2. Description of the Related Art

In ink jet printing, a printhead is provided, the printhead having at least one ink-filled channel for communication with an ink supply chamber at one end of the ink-filled channel. An opposite end of the inkfilled channel has a nozzle opening from which droplets of ink are ejected onto a recording medium. In accordance with the ink droplet ejection, the printhead forms an image on the recording medium.

The ink droplets are formed as an ink meniscus at each nozzle opening experiences the momentum of the expanding bubble formed in the respective channel as a direct result of the voltage pulse applied across the heater in the channel. After a droplet is ejected, additional ink surges to the nozzle opening to re-form the meniscus.

The direction of the ink jet determines the accuracy of placement of the droplet which, in turn, determines the quality of printing performed by the printer. Accordingly, precise jet directionality is an important characteristic of a high quality printhead. Precise jet directionality ensures that ink droplets will be placed precisely where desired on the printed document. Poor jet directionality results in the generation of deformed characters and visually objectionable banding in half-tone pictorial images, particularly so with the newer generation of ink jet printers which enable printing at at least 300 dots per inch. In these high resolution printers the improved print quality demanded by the customer can only be provided if drop directionality were maintained over the entire useful life of the printhead.

Currently available ink jet printers provide accurate placement of ink droplets on a page for only a very limited period of time. The current printers do not maintain high print quality by maintaining the directionality of the ink jet throughout the entire printing lifetime of the printhead.

A major source of jet misdirection is associated with wetting of the front face of the printhead containing at least one nozzle opening. One factor which adversely affects jet directionality accuracy is the interaction of ink previously accumulated on the front face of the print head with the exiting droplets. This accumulation is a direct consequence of the forces of surface tension between the ink and the polar front face of the printhead, the accumulation becoming progressively severe with aging due to oxidation of the front face of the printhead. Ink may accumulate on the printhead front face due to either overflow during the refill surge of ink or the splatter of small droplets resulting from the process of ejecting droplets from the printhead or both. When ink accumulated on the front face of the print head makes contact with the ink meniscus at the nozzle orifice, the meniscus distorts, resulting in an imbalance of forces acting on the ejected droplet. This distortion leads to ink jet misdirection. This wetting phenomenon becomes more troublesome after extensive use of the printhead as the front face either oxidizes or becomes covered with dried ink film. As a result, gradual deterioration of the generated image quality occurs. One way of avoiding these problems is to control the wetting characteristics of the printhead front face so that no accumulation of ink occurs on the front face even after extensive printing. Thus, in order to provide accurate directionality for the exiting jet of ink, wetting of the front face of the printhead ought to be suppressed. This can be achieved by rendering the print head front face hydrophobic.

U.S. patent application Ser. No. 07/874,865, filed on Apr. 28, 1992 now U.S. Pat. No. 5,128,381, the disclosure of which is incorporated by reference herein, discloses a novel hydrophobic coating for the front face of a printhead in an ink jet printer. The coating controls the wetting characteristics of the front face to prevent ink accumulation on the front face. The coating comprises an epoxy adhesive (i.e., resin+curing agent) doped with a silicone rubber compound. The coating can be provided in the form of a 24% solution of the epoxy adhesive (resin+curing agent) and a 30:70 mixture of xylene and methyl iso-butyl ketone by weight doped with 1% by weight of the silicone rubber compound. The proportions of the components of the epoxy mix and the concentration of the epoxy mix in the solvent can be varied to suit a particular method of application. The coating enables the directionality of an ink jet to be maintained for the printing lifetime of the printer.

The application of such a long-lasting hydrophobic coating to the front face of an ink jet print head is extremely crucial to the maintenance of good print quality over the life of the ink jet printer.

OBJECTS AND SUMMARY OF THE INVENTION

An object of the present invention is to provide a method and apparatus for applying a hydrophobic front face coating to an ink jet printhead or printhead die.

Another object of the present invention is provide a method and apparatus for applying a long-lasting hydrophobic coating to the ink jet printhead or printhead die.

A further object of the present invention is to provide a method and apparatus for applying a front face coating to an ink jet printhead or printhead die without requiring a considerable amount of effort.

These and other objects of the invention are achieved by providing a method and apparatus for applying a coating to the front face of an ink jet printhead or printhead die. A block is provided which has a cut out in a top surface thereof. A die is positioned in the cut out such that the die extends from the top surface of the block. An applicator such as a roller or flat blade is used to apply the coating to at least an upper surface of the die as the applicator rides along the upper surface of the die. When a roller is used as the applicator, the roller has a recess corresponding to the extension of the die from the top surface of the block. The roller recess contains a piece of elastomeric material which extends to an outer portion of the roller adjacent to the roller recess. The method and apparatus facilitate transfer of a thin, uniform film of coating to an ink jet printer or printhead die.

BRIEF DESCRIPTION OF THE DRAWINGS

The invention will be described in detail with reference to the following figures in which like reference numerals refer to like elements and wherein.

DETAILED DESCRIPTION OF PREFERRED EMBODIMENT

Figure 1:
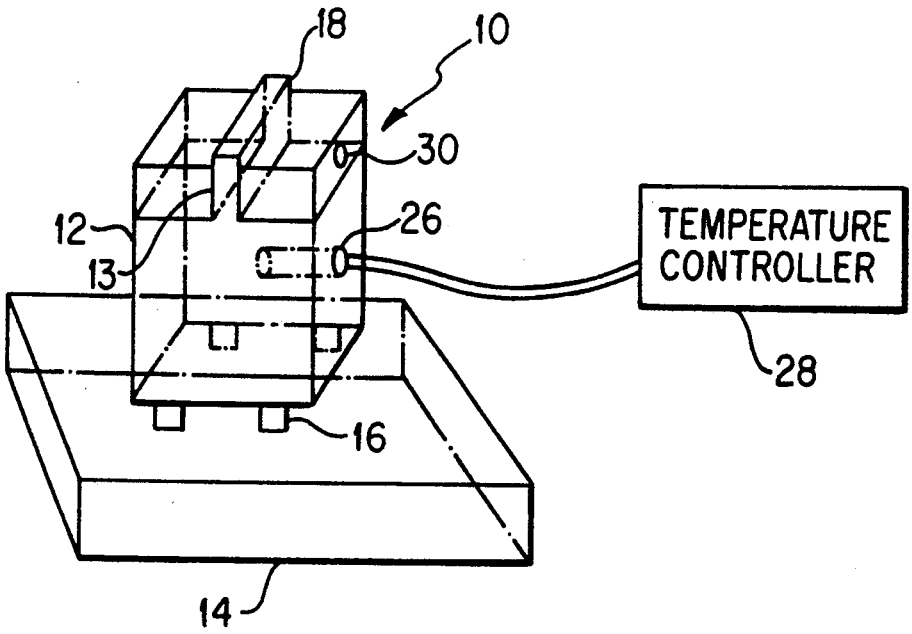
FIG. 1 is a schematic view of the apparatus according to the present invention.

Referring now to the figures and more particularly to FIG. 1 thereof, an apparatus 10 according to the present invention is described.

Apparatus 10 comprises an block 12 of, for example, aluminum having a cut-out 13 located in a top surface thereof. Aluminum block 12 can be mounted on a stand 14 by way of isolators 16.

Cut-out 13 of aluminum block 12 has a width of approximately 4–5 mm. Cut-out 13 of aluminum block 12 receives a die 18; die 18 extending approximately 1 to 3 mm above the top surface of block 12. Accordingly, cut-out 13 must be sufficiently deep to accommodate die 18 such that the approximate 1 to 3 mm portion of die 18 extends above the top surface.

Coating transfer is preferably performed at approximately 65° C., although formulations facilitating room temperature transfer can also be transferred using this apparatus. To effect the coating transfer at a temperature higher than room temperature, aluminum block 12 has a heater 26 located therein. Heater 26, which is controlled by a temperature controller 28 and a thermistor such as an RTD sensor located next to the heater, maintains the temperature of aluminum block 12 at approximately 65°±1° C.

Cut-out 13 has two parts which are joined together via screw 30. Screw 30 allows one to adjust the distance between the two faces of the cut-out, which, in turn, allows one to hold the die firmly in place or release the same simply by turning the screw one way or the other.

Figure 2:
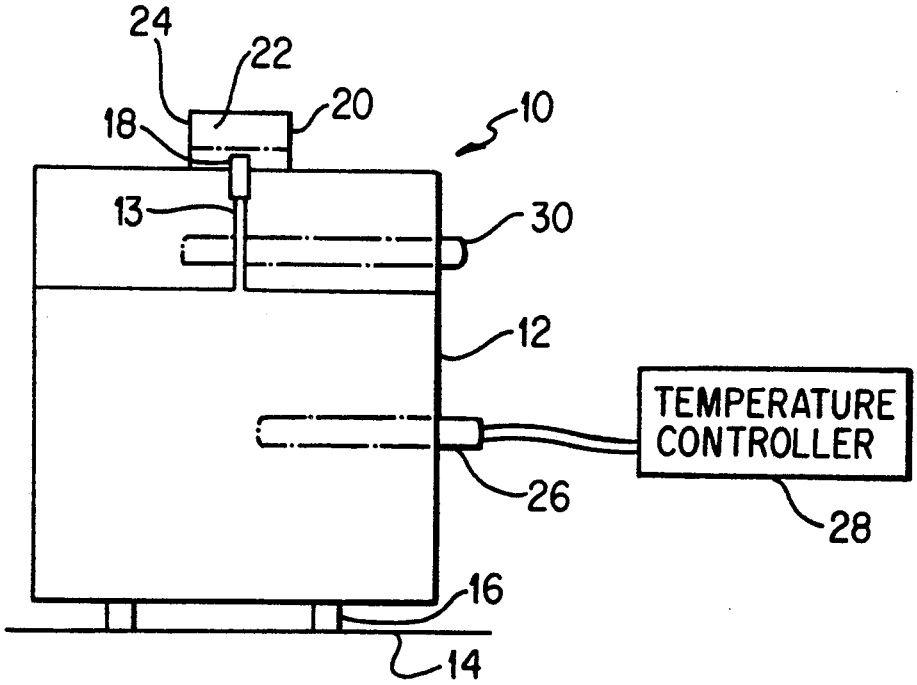
FIG. 2 provides a schematic illustration of the device for transfer of the hydrophobic coating.

FIG. 2 illustrates the application of a coating to at least a top surface of die 18.

A roller 20 can be used for application of the coating. Roller 20 is approximately 50–60 mm wide. Roller 20 has a recess which is substantially 10–12 mm deep in a middle portion thereof. The roller recess 24 is filled with an elastomeric material 22 such as a thick piece of neoprene rubber having a thickness of approximately 8–9 mm. The elastomeric material 22 wraps completely around roller 20.

Roller 20 has an outer portion. The diameter of the outer portion of roller 20 is approximately 1–3 mm larger than the inner portion of the roller. The outer portion can be ground to provide the recess in the roller. Such an arrangement allows for smoother motion of the roller, and a more intimate contact between the die and the roller during transfer. The hydrophobic coating is applied to at least the top surface of die 18 by moving roller 20 smoothly across at least the top surface of die 18 over the aluminum block 12.

Alternatively, a different applicator such as a flat blade can be used to apply the hydrophobic coating to at least the top surface of die 18. The flat blade would have the coating material provided on one surface thereof such that sliding the blade across the top surface of die 18 would cause the coating to be applied to at least the top surface of die 18 above the aluminum block 12.

Alternatively, a film of the coating material could be spun onto a mylar disk. Subsequently, the side with the film is pressed against either the printhead or the printhead die and simply either by rolling the roller or moving the flat blade over the other side of the mylar disk, a thin film of the coating material is transferred to either the printhead or the die.

Using the above-described arrangements, a very thin, uniform film of the hydrophobic front face coating formulation can be easily transferred to either a die or a completed printhead.

This manner of applying a hydrophobic coating provides a longlasting coating which is extremely crucial to the maintenance of good print quality over the life of the printer. The advantage of this manner of application is the ease of application of a water resistant coating to the front face of either a die or a completed printhead at any stage including the restoration of printheads in the field. The characteristics of this manner of application include favorable adhesion and favorable advancing and receding contact angles against water and various inks.

While the invention has been described with reference to particular preferred embodiments, the invention is not limited to specific examples described above. It is evident that many alternatives, modifications and variations will be apparent to those skilled in the art. Accordingly, the preferred embodiments of the invention as set forth herein are intended to be illustrative not limiting. Various changes may be made without departing from the spirit and scope of the invention as defined in the following claims.

What is claimed is:

1. An apparatus for application of a coating to one of an ink jet printhead die and a front face of an ink jet printer printhead, comprising:

a block having a top surface, a bottom surface and four side surfaces, said top surface of said block having a cut out located therein;

a die or front face located in said cut out, said die or front face extending above said top surface of said block; and an applicator for riding along at least an upper surface of said die or front face, said applicator applying a coating to at least said upper surface of said die or front face.

2. The apparatus according to claim 1, wherein said applicator is a roller, said roller having a recess into which said die or front face extends.

3. The apparatus according to claim 2, wherein said roller is covered with an elastomeric material.

4. The apparatus according to claim 3, wherein said elastomeric material is neoprene rubber.

5. The apparatus according to claim 3, wherein said roller is substantially 50–60 mm wide and said roller recess is substantially 10–12 mm deep.

6. The apparatus according to claim 5, wherein said roller recess contains substantially a 8–9 mm thick piece of said elastomeric material, an outer portion of said roller adjacent said roller recess being ground such that said roller recess is substantially 1–3 mm deeper than said outer portion of said roller.

7. The apparatus according to claim 6, wherein said outer portion of said roller has a diameter which is substantially 1–3 mm larger than a diameter of an inner portion of said roller.

8. The apparatus according to claim 1, wherein said cut out has a width in a range of substantially 4–5 mm.

9. The apparatus according to claim 1, wherein said die or front face extends in a range of substantially 1–3 mm above said top surface of said block.

10. The apparatus according to claim 1, wherein said block is aluminum.

11. The apparatus according to claim 1, wherein a heater is located in said block, said heater maintaining said block at a temperature of substantially 65°±1° C., said heater being controlled by a temperature controller and a thermistor.

12. The apparatus according to claim 1, wherein said applicator is a flat blade.

13. The apparatus according to claim 1, wherein a screw is provided in an upper portion of said block, said screw holding together areas of said block adjacent said cut out.

14. A method for applying a coating to one of an ink jet print head die and front face of an ink jet printer print head, comprising the steps of:

positioning a die or front face in a cut out in a top surface of a block such that said die or front face extends above said top surface of said block; and applying a coating to an upper surface of said die or front face by riding an applicator having said coating on a surface thereof along said upper surface of said die or front face.

15. The method according to claim 14, wherein said applicator is a roller having a recess into which said die or front face extends and said applying comprises riding said roller along at least said upper surface of said die or front face.

16. The method according to claim 14, wherein said applicator is a flat blade and said applying comprises sliding said flat blade along at least said upper surface of said die or front face.

17. The method according to claim 14, including the steps of positioning a heater in said block to control a temperature of said block at substantially 65°±1° C. and controlling said heater by a temperature controller and a thermistor.

* * * * *